US005467567A

United States Patent [19]

Christensen

[11] Patent Number: 5,467,567

[45] Date of Patent: Nov. 21, 1995

[54] SPRING BIASED APPARATUS FOR MAINTAINING PRECAST PANELS IN A STABLE REMOVABLE POSITION IN A VERTICAL SLOT

[75] Inventor: Stephen M. Christensen, Leesburg, Va.

[73] Assignee: The Reinforced Earth Company, Vienna, Va.

[21] Appl. No.: 400,492

[22] Filed: Mar. 8, 1995

Related U.S. Application Data

[63] Continuation of Ser. No. 311,209, Sep. 23, 1994, abandoned, which is a continuation of Ser. No. 997,871, Dec. 29, 1992, abandoned.

[51] Int. Cl.[6] ..... E04C 3/00

[52] U.S. Cl. ..... 52/459; 52/144

[58] Field of Search ..... 52/144, 259, 459, 52/477, 769, 773, 774; 404/6; 256/19, 24–29, 13.1

[56] References Cited

U.S. PATENT DOCUMENTS

| | | | |
|---|---|---|---|
| 3,305,993 | 2/1967 | Nelsson | 52/459 |
| 3,359,700 | 12/1967 | Birum | 52/459 |
| 3,921,346 | 11/1975 | Sauer | 52/781 X |
| 3,934,382 | 1/1976 | Gartung | 52/144 |
| 3,948,009 | 4/1976 | Bernhard | 52/144 |
| 4,214,411 | 7/1980 | Pickett | 52/144 |
| 4,272,938 | 6/1981 | Seipos | 52/774 X |
| 4,324,082 | 4/1982 | Rutkowski | 52/781 X |
| 4,437,542 | 3/1984 | Yeager | 52/144 X |
| 4,529,174 | 7/1985 | Pickett | 256/27 |
| 5,092,100 | 3/1992 | Lambert | 52/774 |
| 5,136,821 | 8/1992 | Child | 52/144 |
| 5,161,783 | 11/1992 | German | 256/19 |
| 5,179,810 | 1/1993 | Gename | 52/773 X |
| 5,274,971 | 1/1994 | Elmore et al. | 52/144 |

FOREIGN PATENT DOCUMENTS

| | | | |
|---|---|---|---|
| 430921 | 6/1991 | Austria | 52/459 |
| 2483542 | 12/1981 | France | 256/19 |
| 2496153 | 6/1982 | France | 256/19 |

OTHER PUBLICATIONS

Brochure from the Fanwall Corporation regarding Durisol™.

*Primary Examiner*—Carl D. Friedman
*Assistant Examiner*—Beth A. Aubrey
*Attorney, Agent, or Firm*—Banner & Allegretti, Ltd.

[57] ABSTRACT

An apparatus for wedging a road barrier panel between opposed flanges of an I-beam post includes a spring biased arm retained in a recess hole within the back side of the panel.

21 Claims, 5 Drawing Sheets

SPRING BIASED APPARATUS FOR MAINTAINING PRECAST PANELS IN A STABLE REMOVABLE POSITION IN A VERTICAL SLOT

This application is a continuation of application Ser. No. 08/311,209 filed Sep. 23, 1994, which is a continuation of application Ser. No. 07/997,871 filed Dec. 29, 1992.

BACKGROUND OF THE INVENTION

This invention relates to an improved apparatus for holding a road barrier panel tightly and erect in slots provided in opposed support posts.

Multi-lane roadways and rail lines are often a source of constant and undesirable noise due to traffic. To counteract the dispersion of noise from such roadways, various barrier constructions have been developed. For example, timber or wood barriers, metal barriers, concrete barriers and composite material barriers of one type or the other have been proposed and erected in an effort to counteract noise or to dampen the noise emanating from roadways.

A type of such barrier is comprised of spaced, steel H-beam support posts which are erected vertically in a concrete footing. The H-beam posts are spaced from one another by a modular distance. Slots defined by opposed flanges in the H-beam posts are aligned to receive the ends of elongated panels. The panels may be fabricated from precast concrete or a combination of precast concrete with sound adsorbent materials. The panels are assembled in the vertical H-beam posts by sliding each panel downward into the vertical slots defined by the flanges of the posts. Stacking of panels supported by the posts one on top of the other creates a barrier of a desired height. The panels, for example, may have dimensions of 3 feet in width by 12 feet in length by 7 inches in thickness and may be stacked in the manner described in layers of one to as many as eight panels high.

The particular construction described has been found to be highly useful, economical to manufacture and easy to assemble. Further, such a barrier construction has been found to be highly effective in reducing sound dispersion.

During the erection process, various devices have been proposed for maintaining the panels in place in the slots defined by the opposed H-beam posts. For example, anchor brackets have been used. In addition, wedges made from blocks of wood have been utilized.

While these methods for positioning the panels have been useful, they often require assembly techniques which are very time consuming and which may preclude easy disassembly of the walls. Thus, there has resulted a need to provide an improved device for erecting, aligning and maintaining panels of the type described when constructing a multi-panel barrier. The present invention contemplates such a development.

SUMMARY OF THE INVENTION

In a principal aspect, the present invention comprises an apparatus as well as a method for wedging the side edge of a road barrier panel into a slot in a panel support post wherein the slot is defined by generally vertical spaced flanges of the post. More specifically, the invention comprises spring biased arms retained near each side of the panel in the face of the panel. The arms bias outwardly from the panel and engage one side or flange defining the slot to thereby tightly wedge the opposite face of the panel against the other flange.

Thus, it is an object of the invention to provide an improved post and panel construction for sound barriers and other types of roadway barriers.

It is a further object of the invention to provide an improved method and apparatus for tightly wedging the panels of a traffic barrier in position in the slot of a vertical post associated with the barrier.

One further object of the invention is to provide a spring biased arm which in combination with the panel will more tightly retain the panel in a vertical slot associated with a support post of a sound barrier.

It is yet another object of the invention to provide a biasing mechanism for supporting a panel which is easy to assemble and which may be assembled generally more rapidly than prior art constructions.

Yet another object of the invention is to provide a traffic and sound barrier assembly which may be assembled more safely.

Another object of the invention is to provide a panel and post construction for a sound barrier for roadways which is economical, has few parts and which may be disassembled with relative ease in the event disassembly is necessary.

These and other objects, advantages and features of the invention will be set forth in the detailed description which follows.

BRIEF DESCRIPTION OF THE DRAWINGS

In the detailed description which follows, reference will be made to the drawing comprised of the following figures.

DESCRIPTION OF THE PREFERRED EMBODIMENT

Prior Art Constructions

Figure 1:
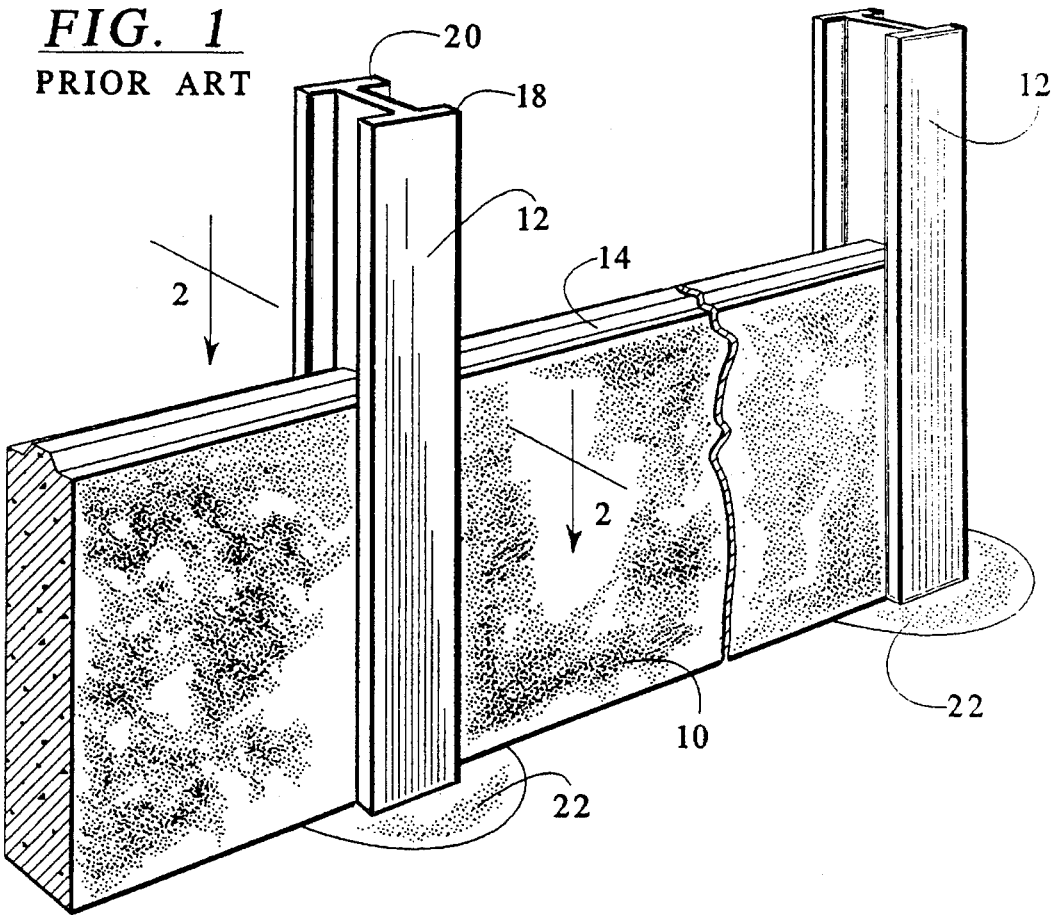
FIG. 1 PRIOR ART
FIG. 1 is a perspective view of a typical post and panel construction which may incorporate the improved apparatus for wedging of the present invention.

A typical prior art panel construction such as generally depicted in FIG. 1 includes a series of precast panels 10 which are arranged for cooperation with vertical, spaced posts 12. The panels 10 are typically fabricated from a precast concrete material or a composite concrete and sound absorbent material. Thus, a panel 10 may have a height of approximately two to four feet with a length of anywhere from 5 to 20 feet and depth of anywhere from 4 to 8 inches. The particular dimensions of the panels 10 are not a limiting feature of the invention, however.

Figure 5:
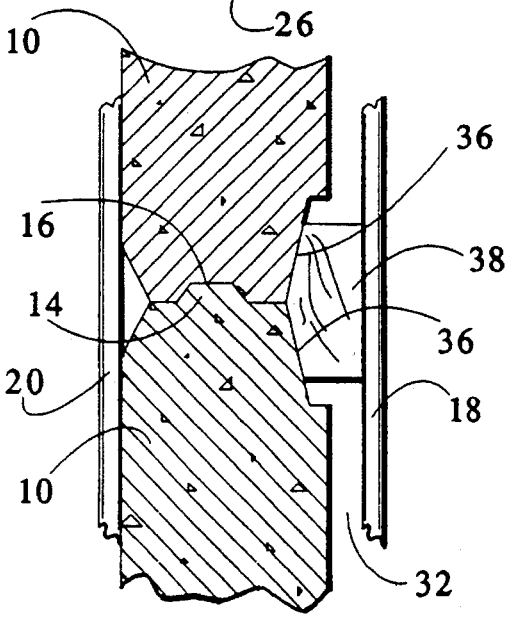
FIG. 5 PRIOR ART
FIG. 5 elevation view of the alternative prior art construction of FIG. 4 taken along the line 5—5.

Panels 10 are often precast and transported to an assembly site. The panels 10 also usually include a tongue and groove construction, such as depicted in FIG. 5, or some other interlocking construction. Thus, each panel 10 will include a tongue 14 along one side of a panel which is cooperative with a groove 16 along a side of the next adjacent panel 10. The sides of the panel 10 have generally planar outside surfaces and fit between flanges 18 and 20 of an H-beam post 12 which is set into a footing 22. Spaced footings 22 thus support separate H-beam posts 12. The panels 10 slide into the opposed channels or slots defined by flanges 18 and 20 of the spaced I-beam posts 12.

Figure 2:
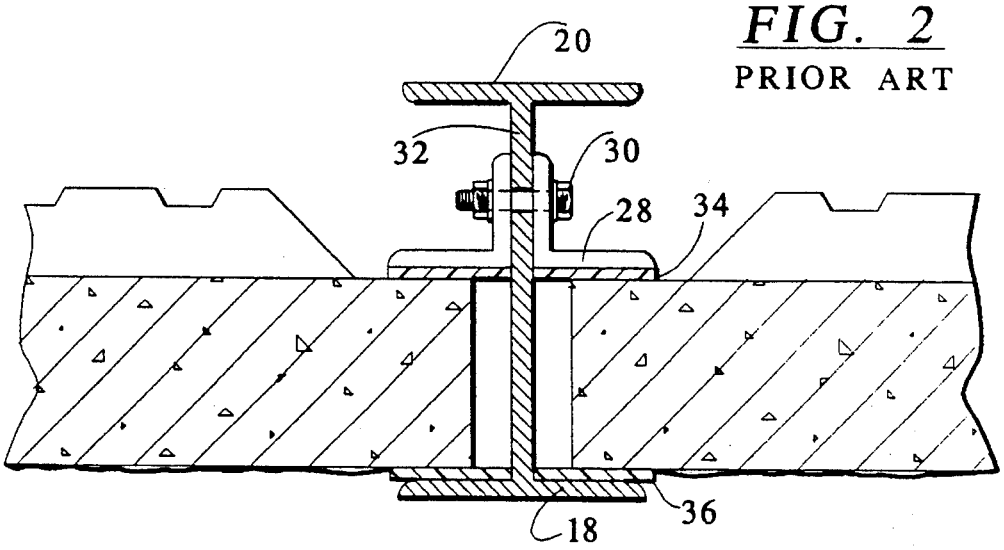
FIG. 2 PRIOR ART
FIG. 2 is a cross-sectional view of a prior art post and panel construction that could be taken along line 2—2 in FIG. 1.
Figure 3:
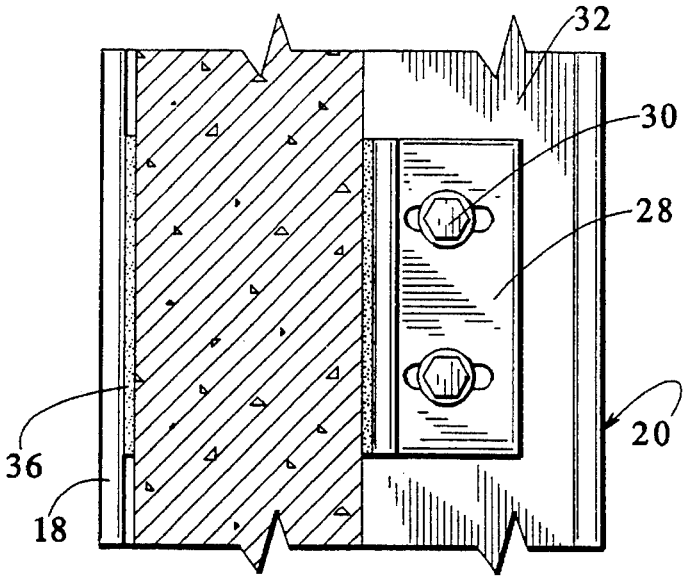
FIG. 3 PRIOR ART
FIG. 3 is a side elevation of the post and panel construction of FIG. 2 taken along the line 3—3.

The flanges 18 and 20 are connected by a web 32 and are spaced one from the other by a distance which is typically greater than the length of the panels 10. Thus a construction must be utilized which will tightly hold or wedge the panels 10 into position between the flanges 18 and 20. FIGS. 2 and 3 illustrate a typical prior art construction for maintaining the panels between the flanges 18 and 20 of an I-beam post 12. That is, panel 10 is held in position against flange 18 by means of a bracket or angle 28 which is bolted by means of bolts 30 to web 32 of H-beam post 12. Elastomeric pads 34 and 36 may be inserted between the bracket 28 and panel 10 and flange 18 and panel 10 to facilitate maintenance of the panel 10 tightly in position. In practice brackets 28 are arranged on both sides of the web 32 to maintain adjacent panels 10 tightly in position with respect to the post 12. FIGS. 2 and 3 illustrate this construction.

Figure 4:
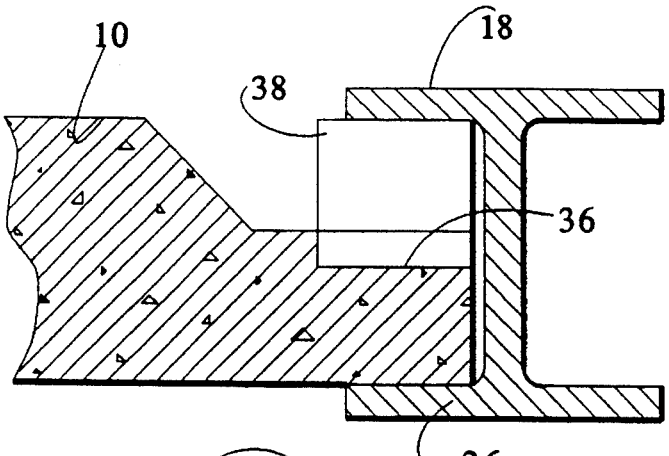
FIG. 4 PRIOR ART
FIG. 4 is a Sectional view of an alternative prior art construction similar to FIG. 2.

FIGS. 4 and 5 illustrate yet another prior art construction wherein the panels 10 include a recess 36 at each corner thereof. A wooden block or wedge 38 is shaped to fit into the recesses 36 of vertically adjacent panels 10 to wedge the panels 10 against a forward flange 26. The block 38 thus engages against flange 18 and the recesses 36 to wedge the panels 10.

Embodiments of the Invention

Figure 6:
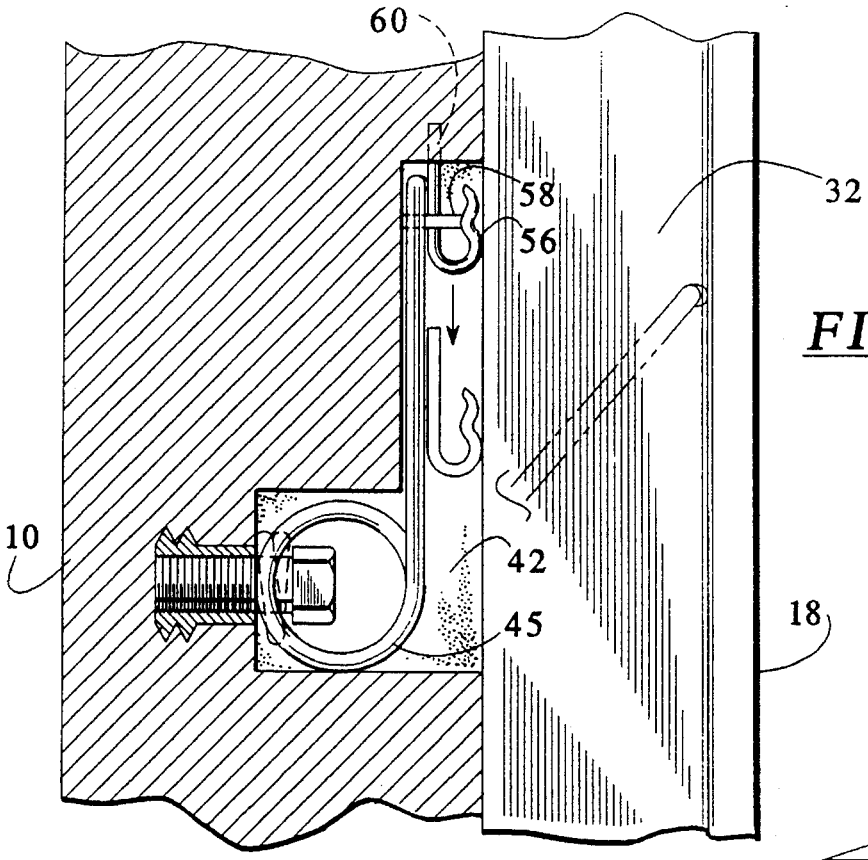
FIG. 6 is a side elevation of the improved post and panel construction incorporating the device of the present invention.
Figure 7:
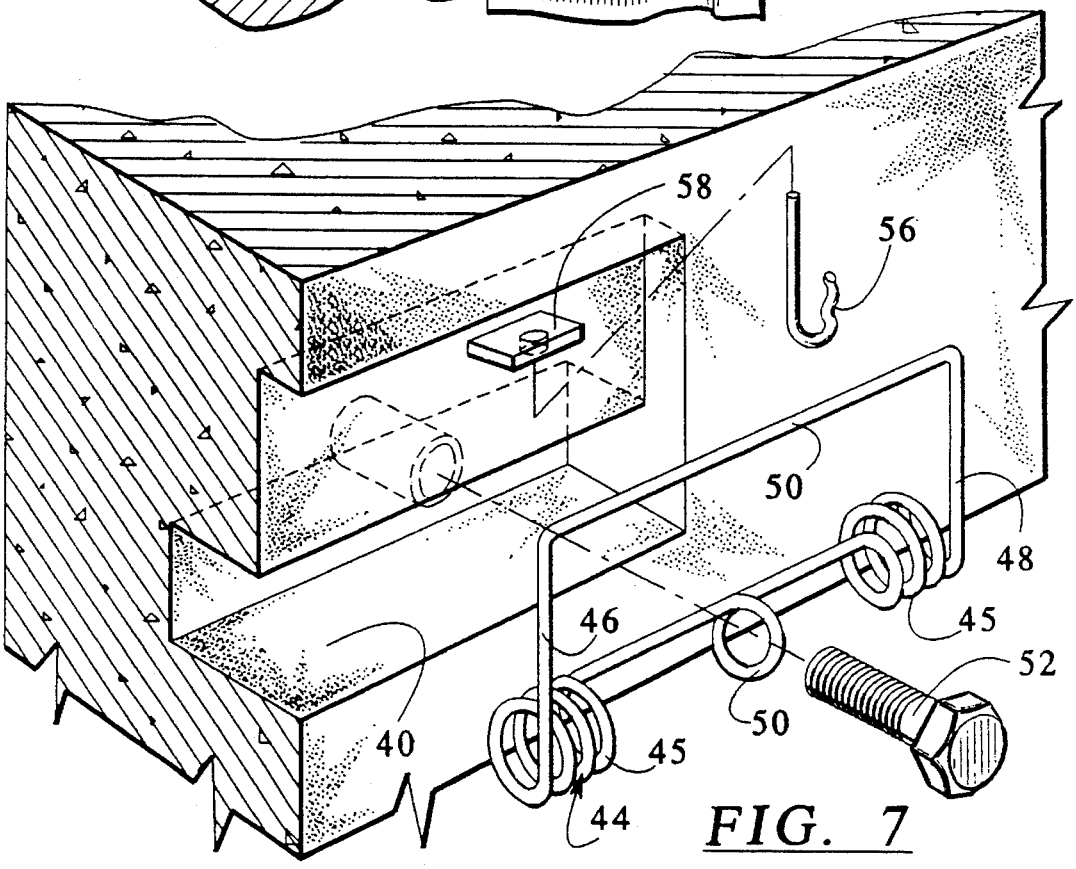
FIG. 7 is a exploded perspective view of the improved device or wedging mechanism of the present invention as incorporated in a panel.
Figure 8:
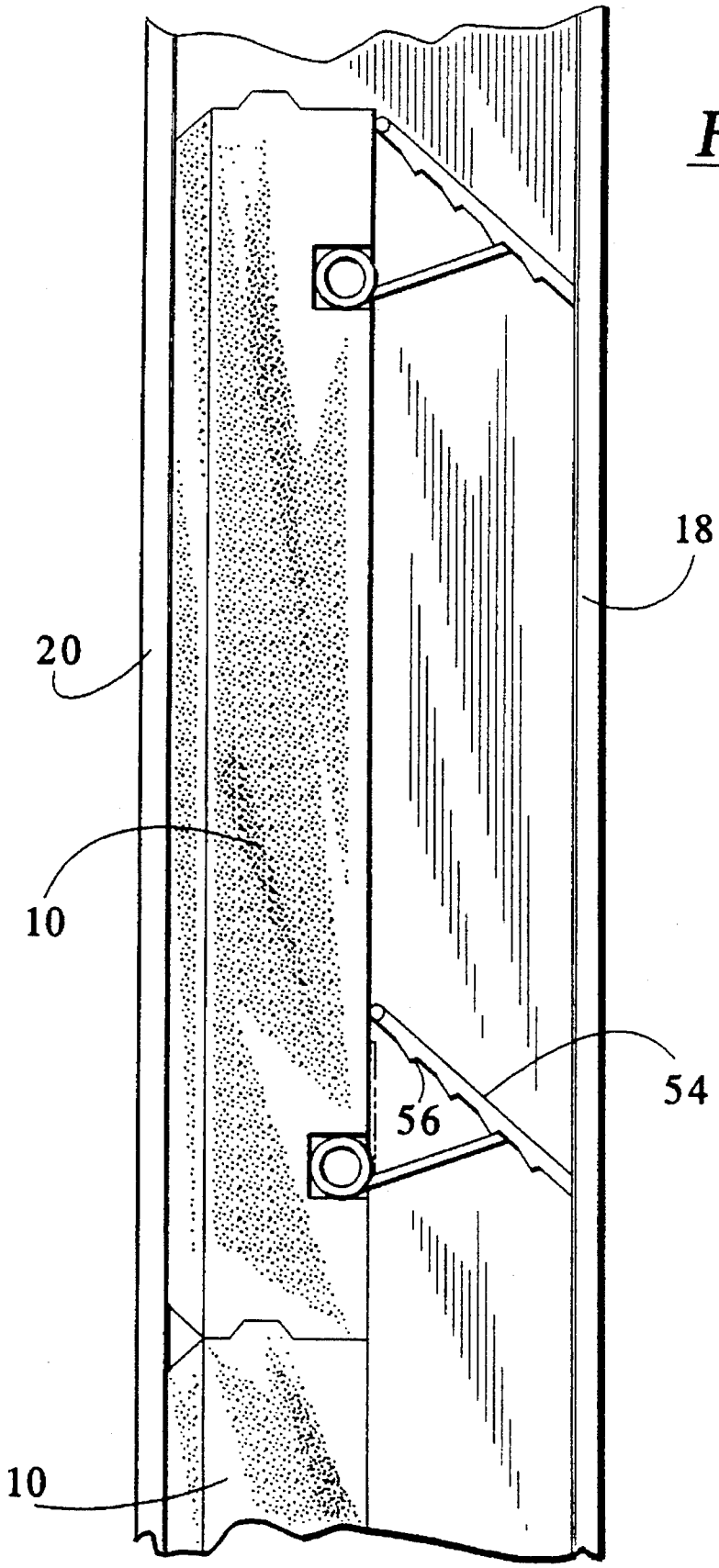
FIG. 8 is an enlarged side elevation similar to FIG. 6 illustrating the improved apparatus of the present invention.

FIGS. 6, 7 and 8 illustrate in greater detail the apparatus of the present invention. In the construction illustrated in these figures, the panel 10 includes a slot 40 which is positioned at each of the corners of the panel 10 adjacent the side 11 of the panel 10. The panel 10 also includes a recess 42 connected with the slot 40. An integral torsion coil spring member 44 includes a first prong or arm 46 extending from one side of the spring coil 45 and a second prong or arm 48 extending from the other side of the spring coil 45. The torsion spring member 44 also includes a center loop 50 for receipt of a fastener 52 such as a bolt. The arms 46 and 48 are optionally connected by a cross member or cross arm 50. The bolt 52 fits through an opening defined by the loop 50 and into a threaded bore or fitting 54 countersunk in the panel 10. Thus the bolt 52 retains as the assembly comprised of the coil 45 and arms 46 and 48 in the slot 40. The coil 45 biases the arms 46 and 48 in the clockwise direction as depicted in FIG. 6.

Prior to insertion of the panel 10 between flanges 18 and 20 of post 12, the arms 46 and 48 as well the cross member 50 are retained within the slot 42 by means of a cotterpin 56 which cooperatively fits through an opening in a plate 58 and into a passage 60 in panel 10 to retain the arms 46 and 48 in the position as depicted in FIG. 6. In the situation where the panel 10 is being combined with a post 12, the pin 56 is first removed to thereby release the arms 46, 48 for movement outward due to the action of the spring 44. The panel 10 is then lowered into the vertical slot defined in opposed posts 12. The panels 10 thus move downwardly between the flanges 18 and 20 defined in the posts 12 by moving in the direction of the arrow in FIG. 6. The torsion spring 44 acting through the arms 46 and 48 which engage flange 20 will cause the panel 10 to be moved toward the flange 18 and retained in position against the flange 18. A plurality of such spring actuated wedging devices may be used in each side of each panel 10. As depicted in FIG. 8 at least two such wedging devices may be utilized to hold a panel 10 in position. More than two may also be utilized depending upon the strength of the spring 44 and other engineering requirements.

FIG. 8 illustrates some further features of the invention. As shown in FIG. 8 an auxiliary keeper bar 54 may be utilized to lock the arms 46 and 48 as well as the cross member 50 into position. The keeper bar is comprised of an elongated bar with projecting tabs 56. The opposite ends of the bar 54 may be coated with highly adherent material to assist in the wedging action. Note that the cross member 50 may be coated with some type of material such as adhesive material or rubberized material to facilitate the locking of the arms and cross member 50 into position.

Figure 9:
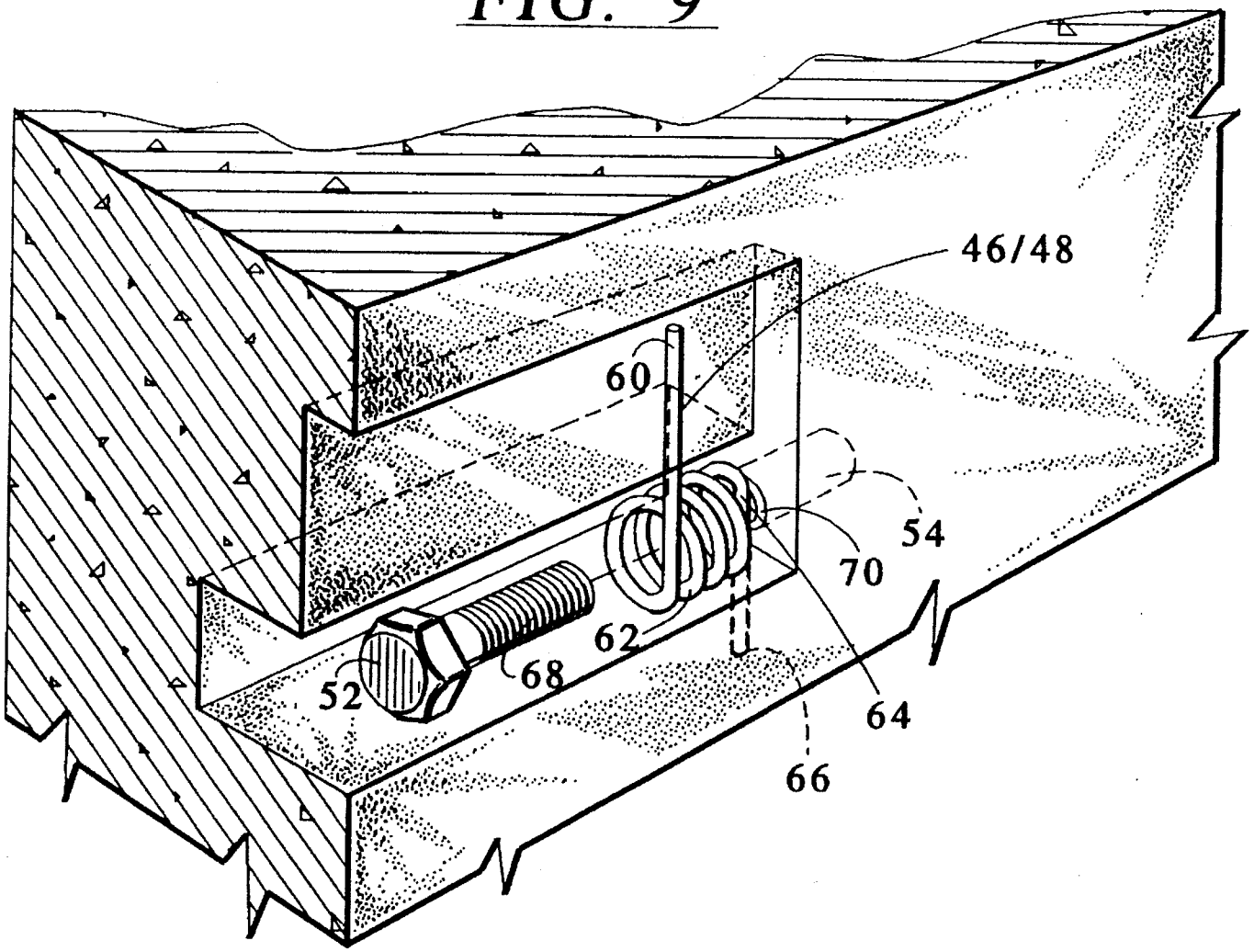
FIG. 9 perspective view of an alternative embodiment of the invention.

FIG. 9 depicts an alternative embodiment of the invention wherein a single prong 60 is biased by a torsion coil spring 62. The spring 62 includes a lead wire 64 which fits into an opening 66 in the panel 10. A bolt 68 fits through the coil 62 and threads into a fitting 70 recessed in the panel 10. The slot 40 and recess 42 in panel 10 are substantially the same as previously described.

Additionally, there are other alternative features which may be adopted. For example, the cross member 50 may be eliminated from the embodiment of FIG. 7. A series of arms 46 and 48 arranged in generally parallel relation may be utilized rather than one or two arms or prongs. A series of fasteners such as the fastener 52 may be utilized to hold the spring 44 in position within a recess 40 of the slot 42. The shape and configuration of the recess 40 may be altered as desired. The biasing mechanism, namely the spring 44, may be any of a series of choices other than the coil spring 44 which is depicted. Thus the invention is to be limited only by the following claims and their equivalents.

What is claimed is:

1. A road barrier panel and post construction, said panel of the type having spaced, opposite faces connected by spaced opposite sides, said post having spaced flanges defining a slot, said slot slidably receiving one side of the panel with the panel faces opposed to the flanges;

and wedging apparatus interposed between a flange and panel face, said wedging apparatus comprising, in combination:

a biasing member attached to the panel at a face thereof; and an arm engaged by the biasing member and extendable from the panel toward one flange with a sufficient force and at an angle to thereby wedge the panel in the slot.

2. The apparatus of claim 1 wherein the biasing member comprises a coil torsion spring defining an axis along the center line of the coil and the arm comprises a prong affixed to the spring extending generally perpendicular to the axis.

3. The apparatus of claim 1 wherein the biasing member comprises a coil spring and further including at least two prongs extending generally tangentially from and connected to the coil spring.

4. The apparatus of claim 3 further including a cross bar connecting at least two prongs.

5. The apparatus of claim 3 further including a cross bar connecting at least two prongs.

6. The apparatus of claim 1 wherein said panel includes a recess in one face at one side thereof for receipt of the biasing member, and further including means for attaching the biasing member in the recess and for holding a torsion spring therein to effect biasing movement of the arm toward the flange.

7. The apparatus of claim 6 further including removable means for keeping the arm aligned with the surface and out of engangement with the flange of the slot.

8. The apparatus of claim 7 wherein the means for keeping comprise a latch member removably attached to panel.

9. The apparatus of claim 7 wherein the means for keeping comprise a latch member removably attached to panel.

10. The apparatus of claim 6 further including a separate keeper arm extending between the flange and the panel and engaged by the arm.

11. The apparatus of claim 6 further including removable means for keeping the arm aligned with the surface and out of engagement with the flange of the slot.

12. The apparatus of claim 6 further including a separate keeper arm extending between the flange and the panel and engaged by the arm.

13. The apparatus of claim 1 wherein the biasing member is a torsion coil spring with an axis and which is attached to the panel by a fastener extending axially through the spring.

14. The apparatus of claim 1 wherein the biasing member is a torsion coil spring with an axis and which is attached to the panel by a fastener extending transversely to the axis.

15. The apparatus of claim 1 wherein the biasing member comprises a coil torsion spring defining an axis along the center line of the coil and the arm comprises a prong affixed to the spring extending generally perpendicular to the axis.

16. The apparatus of claim 1 wherein the biasing member comprises a coil spring and further including at least two prongs extending generally tangentially from and connected to the coil spring.

17. The apparatus of claim 1 wherein said panel includes a recess in one face at one side thereof for receipt of the biasing member, and further including means for attaching the biasing member in the recess and for holding the torsion spring therein to effect biasing movement of the arm toward the flange.

18. The apparatus of claim 1 wherein the biasing member is a torsion coil spring with an axis and which is attached to the panel by a fastener extending axially through the spring.

19. The apparatus of claim 1 wherein biasing member is a torsion coil spring with an axis and which is attached to the panel by a faster extending transversely to the axis.

20. A road barrier panel and post construction, said panel of the type having spaced, opposite faces connected by spaced opposite sides, said post having spaced flanges defining a slot, said slot slidably receiving one side of the panel with the panel faces opposed to the flanges;

a wedging apparatus interposed between a flange and panel face, said wedging apparatus comprising, in combination;

a biasing member positioned against the panel at a face thereof; and an arm engaged by the biasing member and extending toward one flange with a sufficient force and at an angle to thereby wedge the panel in the slot.

21. A method for erection of a post and panel wall of the type including at least two spaced posts having opposed slots defined by generally parallel flanges with the panel slidably inserted in the slots and thereby held vertically erect to define a wall comprising the steps of:

(a) erecting the post; and (b) slidably inserting the panel in the slots from the top of the slots, with the panel including at least one spring biased arm attached thereto and insertable in one slot, said arm biased outwardly from the panel to engage one of the flanges thereby driving the panel into engagement with the other flange.

* * * * *